United States Patent [19]

Takeyasu et al.

[11] 4,354,172

[45] Oct. 12, 1982

[54] SYSTEM OF GENERATING SYNCHRONIZING SIGNALS IN A NAVIGATIONAL LIGHT GROUP

[75] Inventors: Isaburo Takeyasu, Takarazuka; Koichi Nagamachi, Kobe; Yuji Sato, Kawanishi, all of Japan

[73] Assignee: Zeni Lite Buoy Co., Ltd., Ikeda, Japan

[21] Appl. No.: 175,420

[22] Filed: Aug. 5, 1980

[30] Foreign Application Priority Data

Aug. 14, 1979 [JP] Japan ..... 54-104197

[51] Int. Cl.[3] ..... G08G 3/00

[52] U.S. Cl. ..... 340/29

[58] Field of Search ..... 340/29, 26; 370/104; 455/12

[56] References Cited

U.S. PATENT DOCUMENTS 3,532,985 10/1970 Glomb et al. ..... 370/104

3,787,867 1/1974 Dodge et al. ..... 340/29

*Primary Examiner*—Thomas A. Robinson

*Attorney, Agent, or Firm*—Darby & Darby

[57] ABSTRACT

Radio signals from at least one Navy Navigation Satellite are received and an accurately timed signal is extracted therefrom. The special signal is used as a synchronizing signal to synchronize the flashing of a plurality of navigation lights. Each navigation light receives the radio signal, extracts the special signal and generates a flash signal which is used to flash a lamp.

9 Claims, 3 Drawing Figures

SYSTEM OF GENERATING SYNCHRONIZING SIGNALS IN A NAVIGATIONAL LIGHT GROUP

FIELD OF THE INVENTION

The present invention relates to a system for generating synchronizing signals for a navigational light group such that a plurality of navigational lights disposed in a predetermined sea area may be visually identified as a light group by navigators.

BACKGROUND OF THE INVENTION

When nighttime marine accidents are studied, it is found that such accidents frequently occur because the navigator's vision is dazzled by increased numbers of recently developed coast lights. This reduces a navigator's ability to recognize navigational lights of the conventional type. There has been a need to establish an identification method which can be visually recognized clearly by navigators at sea.

For such identification, it is most effective to synchronize the flashes from a plurality of navigational lights. Simultaneous and/or rhythmically moving flashes of the navigational lights are effective in helping navigators recognize a light line or a light plane.

However, in order to provide such synchronization, independent lights such as light buoys must be linked with each other by wire or radio communication means.

Except for a few cases, wire communication is undesirable by reason of expense and difficulty in construction. On the other hand, radio communication requires the installation of an exclusive communication system, but the existing Wireless Telegraphy Act renders such installation very difficult.

It has been proposed to synchronize navigational lights by the use of radio waves sent from non-directional radio beacons or external radio waves sent from broadcasting stations such as time casting radio waves.

However, these radio waves have different frequencies which depend on their location, and are susceptible to jamming. Each receiver must thus have a radio wave detector device with high accuracy and highly accurate adjustability. Accordingly, prior to the manufacture and installation of each receiver, it is necessary to measure radio waves in the area where navigational lights and their receivers are installed, and to manufacture a synchronizer suitable to the measured radio waves.

Moreover, when installing navigational lights, the synchronizer should be fine-tuned at the installation site, and such adjustment requires a great deal of labor and time, particularly if the installation site is abroad or remote from the factory.

DISCLOSURE OF THE INVENTION

The present invention provides a system for generating synchronizing signals in a navigational light group which includes a plurality of navigational lights. Each of the navigational lights has a receiver to receive a radio signal sent from a satellite such as a Navy Navigation Satellite, a signal separating detector to separately extract from this signal a special signal such as a 400 Hz signal corresponding to the third word of the signal from the satellite, lighting equipment, a flash signal generator incorporating a frequency divider which determines the intervals of flashes or extinctions of the navigational lights, the flash signal generator being adapted to supply a flash signal (for flashing the light once or blinking it more than once), and a lighting circuit to be driven by the flash signal for flashing or extinguishing the lighting equipment. With such an arrangement, the frequency dividers in the flash signal generators of the respective navigational lights are adapted to be synchronously calibrated by outputs from the respective signal separating detectors so that the lighting equipment in all of the navigational lights is synchronously flashed as a group, either simultaneously or in sequence.

BRIEF DESCRIPTION OF THE DRAWINGS

The present invention will be further described by way of example with reference to the accompanying drawings, in which.

DETAILED DESCRIPTION OF PREFERRED EMBODIMENTS

The present invention provides a system for generating synchronizing signals in a navigational light group within a given sea area by using orbit information signals sent from a satellite, such as one of the Navigation Satellites which orbit the earth in a polar orbit.

The system in accordance with the present invention is operated such that a special signal, for example, the 400 Hz signals contained in these orbit information signals are separated and extracted therefrom. Frequency dividers within flash signal generators in each of a plurality of navigational lights disposed at sea are synchronized by using the extracted special signals as trigger signals, so that lighting equipment in each of the navigational lights is flashed simultaneously or in succession at predetermined intervals through delay circuits, whereby the navigational lights may visually be recognized by navigators as being a group.

The description hereinafter will discuss in detail a preferred embodiment of the present invention, with reference to the accompanying drawings.

Figure 1:
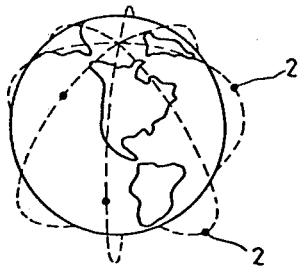
FIG. 1 is a schematic view of the U.S. Navy Navigation Satellite System.

The invention makes use of satellites in a system, of which a typical example is the Navy Navigational Satellite system. The Navy Navigation Satellite System (NNSS) is provided by the US Navy and includes six identical satellites on circular orbits which include the South and North Poles as shown in FIG. 1. The flight cycle is about 107 minutes and the average flight altitude is 1,100 km with slight perturbation. The respective satellites are similar. Two radio waves (VHF and UHF) sent from each of the satellites are controlled by a crystal oscillator having very high accuracy. The clock (on which is based the positional information program signal sent from each of the satellites) is calibrated by the atomic clock A1 at the U.S. Navy Astronomical Observatory, whereby signals sent from the satellites are very accurately timed.

Figure 2:
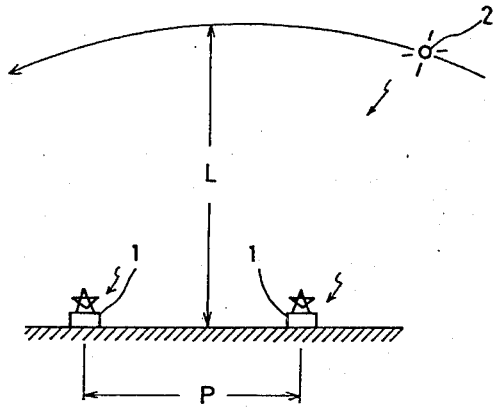
FIG. 2 is a schematic view illustrating the positional relationship between navigational lights and the Navigation Satellite.

FIG. 2 illustrates the relationship between the satellite 2 and a plurality of navigational lights 1 disposed in a sea area in a predetermined pattern having predetermined dimensions. The distance P between two navigational lights 1 is 1 to 2 nautical miles or less. This takes the visual and azimuthal resolving powers of navigators into account. Since the distance between the satellite 2 and the respective navigational lights 1 disposed in a predetermined sea area is as much as 1,100 km, the respective navigational lights 1 can be regarded as equidistant from the satellite 2 at distance L.

Each of the navigational lights 1 has the same receiver to receive a signal from the satellite 2. A special signal such as a 400 Hz signal contained in the signal from the satellite is extracted and utilized as a basic calibration synchronous signal for flashing or extinguishing the navigational lights 1, either simultaneously or in sequence.

Figure 3:
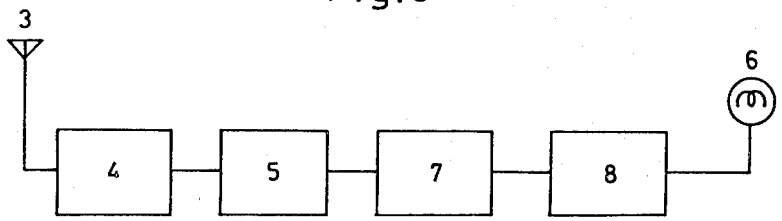
FIG. 3 is a block diagram of circuitry within each navigational light in accordance with the present invention.

Each of the navigational lights 1 contains devices shown in FIG. 3. Namely, each of the navigational lights has an aerial 3 to receive a radio wave sent from, e.g., the Navigation Satellite 2, a receiver 4 connected to the aerial 3, a signal separating detector 5 to separately extract a special signal, such as a 400 Hz signal corresponding to the third word from the output signal from the receiver 4, lighting equipment 6, a flash signal generator 7 incorporating a frequency divider which determines the flash intervals (or, alternatively, the extinction intervals) of the lighting equipment 6 by generating a flash signal, and a lighting circuit 8 driven by the flash signal to flash (or extinguish) the lighting equipment 6.

With such an arrangement, radio waves sent from, e.g., the Navigation Satellite 2 are received up by the aerials 3 and are then received by the receivers 4. From the output signals from the receivers 4, special signals such as 400 Hz signals are then separately extracted by the signal separating detectors 5. Such special signals have a high time accuracy, and the frequency dividers in the flash signal generators 7 are thus synchronized. Thus, with the special signals used as synchronous signals, flash signals from the respective flash signal generators 7 are synchronized, so that the lighting equipment 6 of the navigational lights 1 are simultaneously flashed or extinguished.

It is possible to dispose delay circuits between each flash signal generator 7 and its lighting circuit 8. In this arrangement, flash signals are delayed in the delay circuits, so that the flash signals are supplied to the respective lighting circuits 8 at different times. Accordingly, when the time constants of the respective delay circuits are slightly changed according to the order of the navigational lights 1, it is possible to flash or extinguish the lighting equipment 6 successively in a predetermined sequence, thus permitting the lights to be identified as a group.

It is also possible to use a plurality of inventive systems in combination with each other as one group anywhere on the earth. A given Navigation Satellite can be observed from one place on the earth for about 18 minutes at most. Signals from the satellite may be received intermittently because of the relationship between the satellite's orbit and the earth's rotation on its axis. Accordingly, in a time zone where the radio waves from satellite 2 may be received by the navigational lights 1, a special signal may be received as a synchronous signal at intervals of just two minutes.

The invention utilizes radio waves sent from, e.g., a Navigation Satellite for synchronizing flashes of navigational lights at sea, and thus uses them for a completely new purpose.

Thus, without adversely affecting the radio waves and without infringing the restrictions imposed by the Wireless Telegraphy Act, the navigational lights in the present invention may be flashed, extinguished, or blinked as one group simultaneously or in sequence without requiring special lighting circuits, whereby such navigational lights may be clearly recognized by navigators as being part of a group.

Since the radio waves utilized for such synchronization have the same frequency all over the earth, the present invention may be completely adjusted at the factory. Accordingly, no adjustments are required at the installation site, thus saving turnaround time and trouble.

Furthermore, the present invention may be standardized and therefore economically mass-produced.

Moreover, such radio waves will not be jammed, thereby improving reliability.

We claim:

1. A navigation light adapted for synchronous operation with other lights of like kind in a group, comprising:

means for receiving radio signals transmitted from an orbital satellite and for extracting from such radio signals a special signal;

a lamp;

means for flashing the lamp in response to a flash signal; and means for generating a flash signal in response to the special signal.

2. The navigation light of claim 1, wherein said means for generating comprises a frequency divider.

3. The navigation light of claim 1, further comprising a delay circuit coupling said means for generating to said means for flashing.

4. The navigation light of claim 1, wherein the satellite is a Navy Navigation Satellite.

5. The navigation light of claim 4, further comprising a buoy.

6. A method of synchronizing a plurality of navigation lights, comprising the following steps:

receiving a radio signal transmitted from an orbital satellite;

extracting an accurately timed special signal from the radio signal; and using the special signal as a synchronizing signal for synchronizing a plurality of navigation lights.

7. The method of claim 6, wherein the satellite is a Navy Navigation Satellite.

8. A system for generating synchronizing signals in a navigational light group, comprising:

a plurality of navigational lights disposed in a sea area, each of the plurality of lights having a receiver means for receiving a radio signal from an orbital satellite and extracting from the radio signal a special signal, a lamp, means for flashing the lamp in response to a flash signal, and means for generating a flash signal in response to the special signal.

9. The system of claim 8, wherein the satellite is a Navy Navigational Satellite.

* * * * *